US010768567B2

(12) United States Patent
Kang et al.

(10) Patent No.: US 10,768,567 B2
(45) Date of Patent: Sep. 8, 2020

(54) AUTOMATIC MOUNTING APPARATUS AND IMAGE FORMING APPARATUS INCLUDING SAME

(71) Applicant: HP PRINTING KOREA CO., LTD., Suwon-si, Gyeonggi-Do (KR)

(72) Inventors: Young Goo Kang, Yongin-si (KR); Ji Hoon Woo, Hwaseong-si (KR); Jin Soo Lee, Yongin-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 230 days.

(21) Appl. No.: 15/744,612

(22) PCT Filed: Jul. 7, 2016

(86) PCT No.: PCT/KR2016/007371

§ 371 (c)(1),
(2) Date: Jan. 12, 2018

(87) PCT Pub. No.: WO2017/010737

PCT Pub. Date: Jan. 19, 2017

(65) Prior Publication Data

US 2018/0203395 A1 Jul. 19, 2018

(30) Foreign Application Priority Data

Jul. 14, 2015 (KR) ..... 10-2015-0099555

(51) Int. Cl.
*G03G 15/00* (2006.01)
*B65H 1/26* (2006.01)

(52) U.S. Cl.
CPC ..... *G03G 15/6508* (2013.01); *B65H 1/266* (2013.01); *G03G 15/6502* (2013.01);
(Continued)

(58) Field of Classification Search
CPC ..... G03G 15/6508; G03G 2215/0067; G03G 15/6502; G03G 2221/1654;
(Continued)

(56) References Cited

U.S. PATENT DOCUMENTS 4,564,248 A 1/1986 Grass
5,419,544 A 5/1995 Ono et al.
(Continued)

FOREIGN PATENT DOCUMENTS

CN 1537489 A 10/2004
CN 2916702 Y 6/2007
(Continued)

*Primary Examiner* — Matthew G Marini
*Assistant Examiner* — Marissa Ferguson-Samreth
(74) *Attorney, Agent, or Firm* — Jefferson IP Law, LLP

(57) ABSTRACT

An image forming apparatus comprises a housing, a cassette insertable into the housing to store printing sheets; an automatic mounting apparatus provided between the housing and the cassette and to allow the cassette to be mounted thereon, where the automatic mounting apparatus comprises an engaging portion configured to protrude on a side surface of the cassette, a rail portion provided in the housing, and a locking device provided at the rear side of the rail portion to interfere with the engaging portion.

20 Claims, 23 Drawing Sheets

(52) U.S. Cl.
CPC ..... *B65H 2402/32* (2013.01); *B65H 2402/64* (2013.01); *B65H 2405/114* (2013.01); *B65H 2801/06* (2013.01); *G03G 2215/0067* (2013.01); *G03G 2221/1654* (2013.01); *G03G 2221/1684* (2013.01)

(58) Field of Classification Search
CPC ..... G03G 2221/1684; B65H 1/266; B65H 2402/32; B65H 2402/64; B65H 2405/114; B65H 2801/06
See application file for complete search history.

(56) References Cited

U.S. PATENT DOCUMENTS

| | | | | |
|---|---|---|---|---|
| 6,231,042 | B1 * | 5/2001 | Ito | B65H 3/24 271/157 |
| 7,488,613 | B2 * | 2/2009 | Kunisato | H01L 33/0079 257/79 |
| 7,862,034 | B2 * | 1/2011 | Kobayashi | B65H 1/26 271/145 |
| 7,967,402 | B2 * | 6/2011 | Hoshide | A47B 88/467 312/319.1 |
| 8,100,487 | B2 * | 1/2012 | Liang | A47B 88/463 312/319.1 |
| 8,824,920 | B2 * | 9/2014 | Eto | G03G 21/1842 399/110 |
| 8,991,814 | B2 * | 3/2015 | Hirahara | B65H 3/0684 271/117 |
| 9,009,918 | B2 * | 4/2015 | Haab | E05D 15/0652 16/105 |
| 9,388,619 | B2 * | 7/2016 | Park | E05F 5/003 |
| 9,840,382 | B2 * | 12/2017 | Okazaki | B65H 1/14 |
| 9,896,284 | B2 * | 2/2018 | Yang | B65H 1/14 |
| 10,058,175 | B2 * | 8/2018 | Dubach | A47B 88/47 |
| 10,294,706 | B2 * | 5/2019 | Demir | B60J 5/047 |
| 2004/0237252 | A1 | 12/2004 | Hoshide et al. | |

FOREIGN PATENT DOCUMENTS

| | | | |
|---|---|---|---|
| CN | 103546660 | A | 1/2014 |
| JP | 2004-117395 | A | 4/2004 |
| JP | 2004269112 | A | 9/2004 |
| JP | 2009137756 | A | 6/2009 |
| KR | 10-2008-0084100 | A | 9/2008 |
| KR | 10-2013-0068086 | A | 6/2013 |
| KR | 10-2013-0118891 | A | 10/2013 |
| KR | 10-2014-0084985 | A | 7/2014 |

* cited by examiner

【FIG 1】
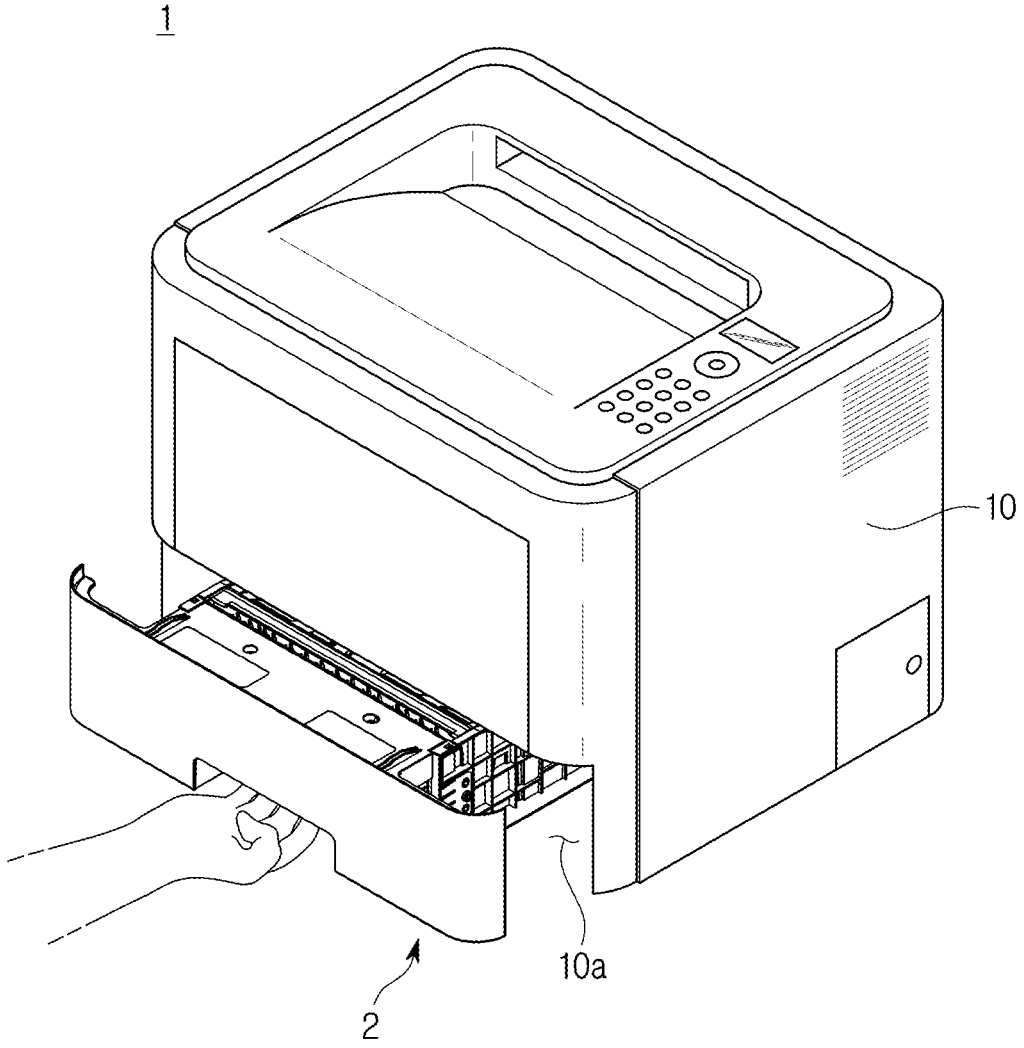

【FIG 2】
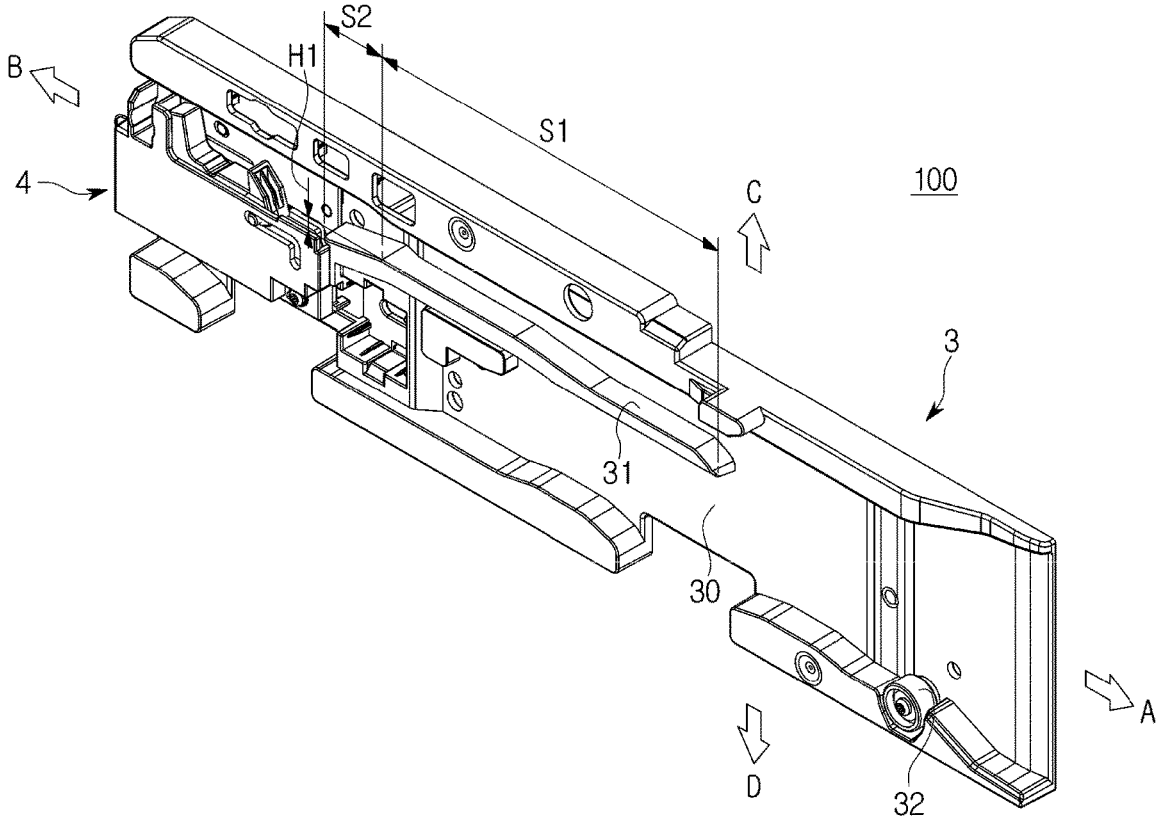

【FIG 3】
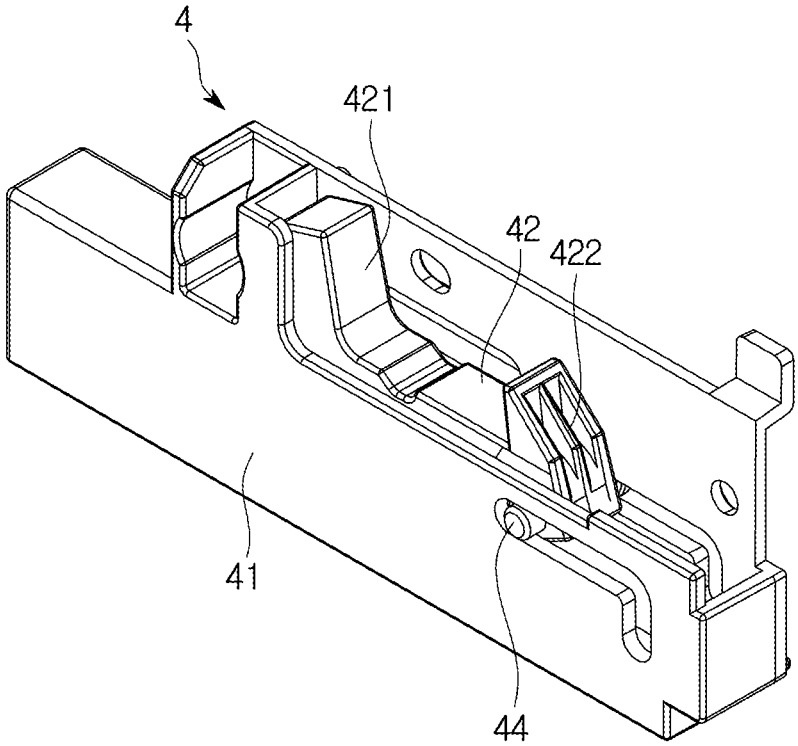

【FIG 4】
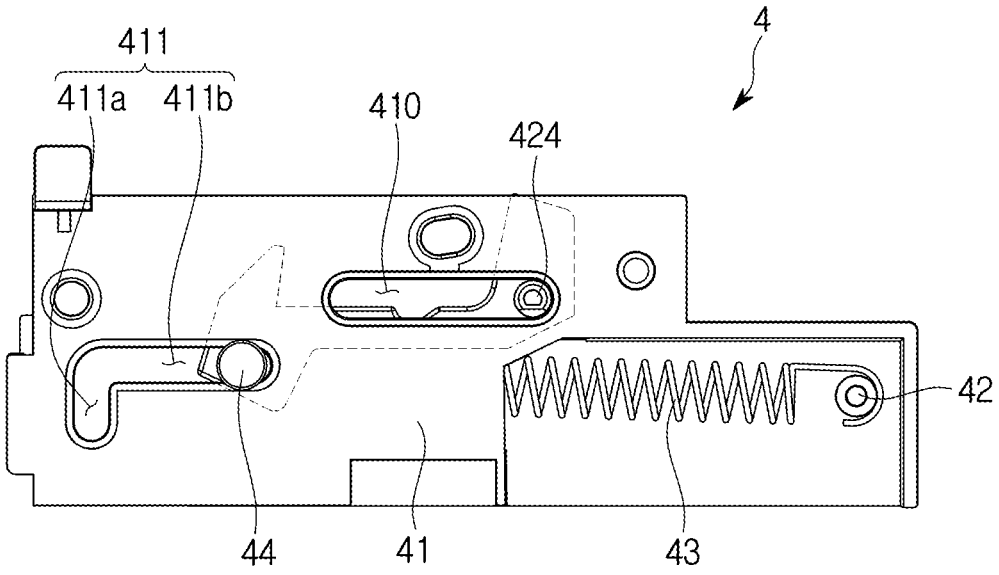

【FIG 5】
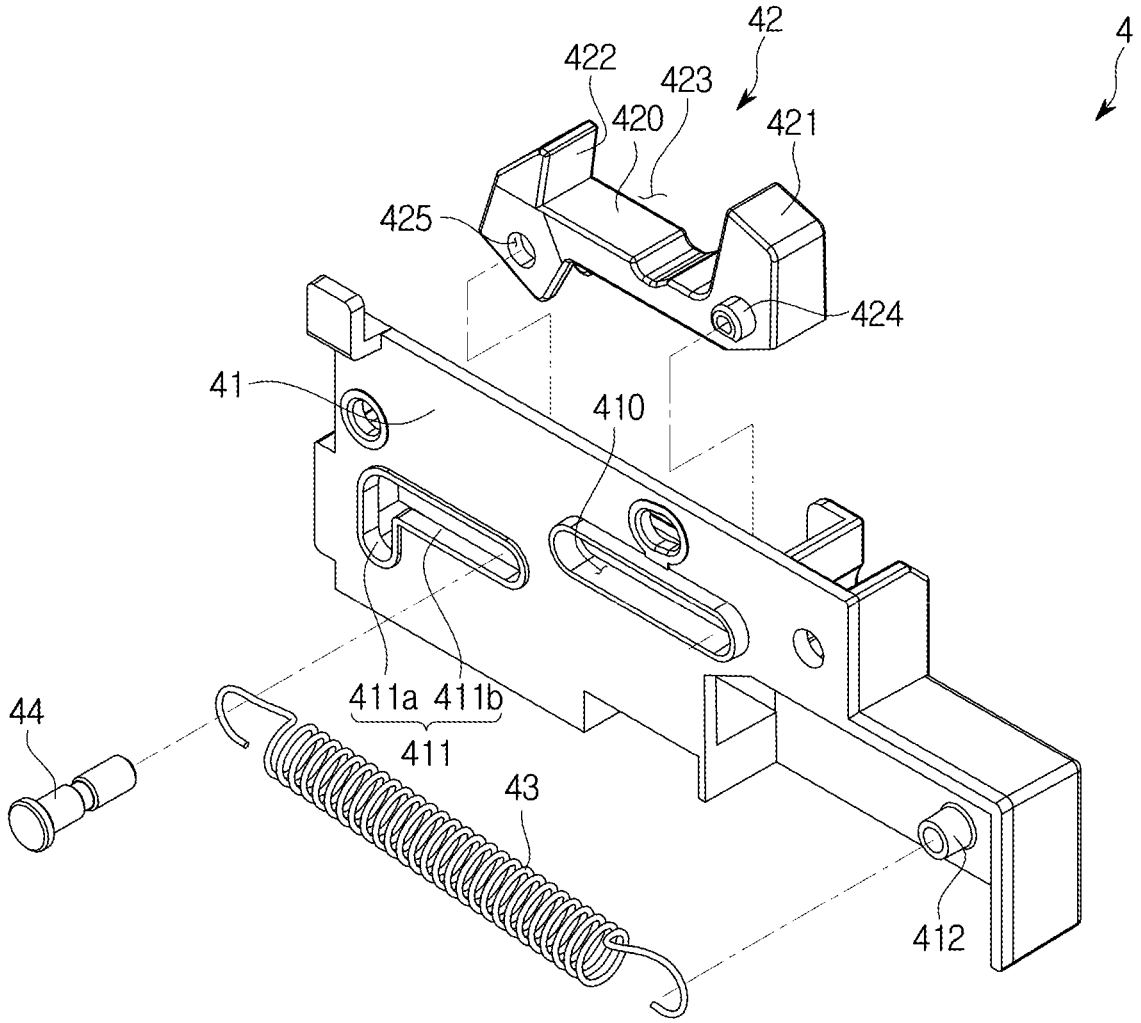

【FIG 6】
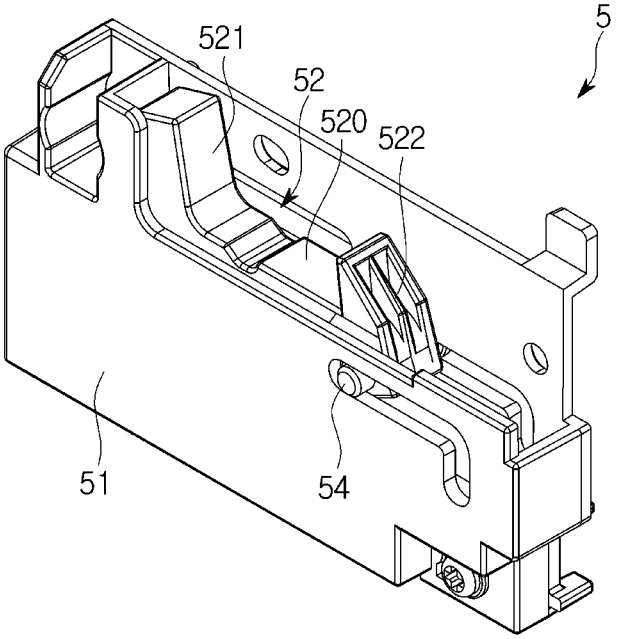

【FIG 7】
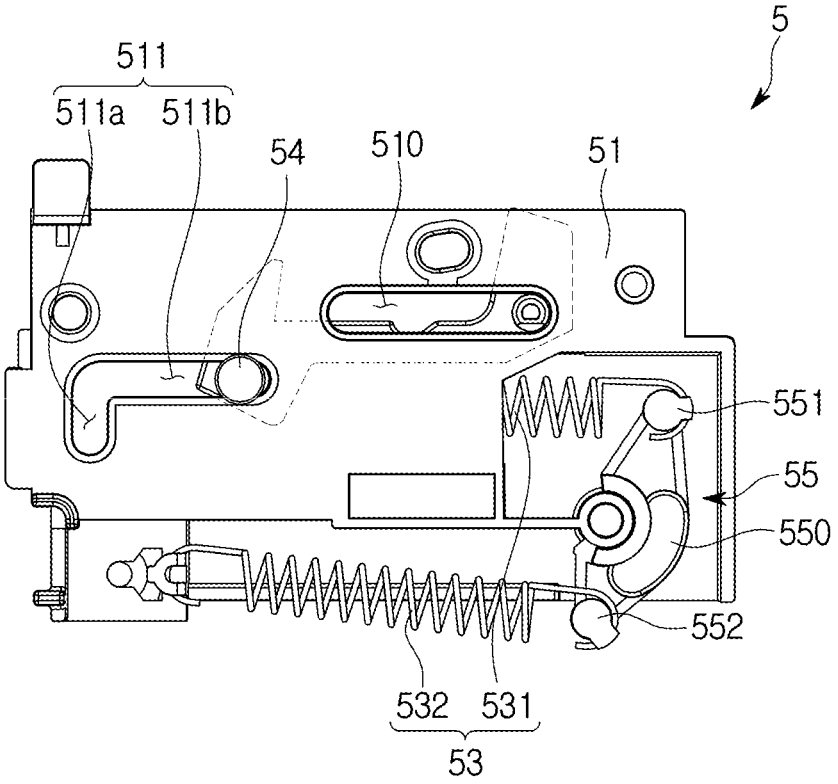

【FIG 8】
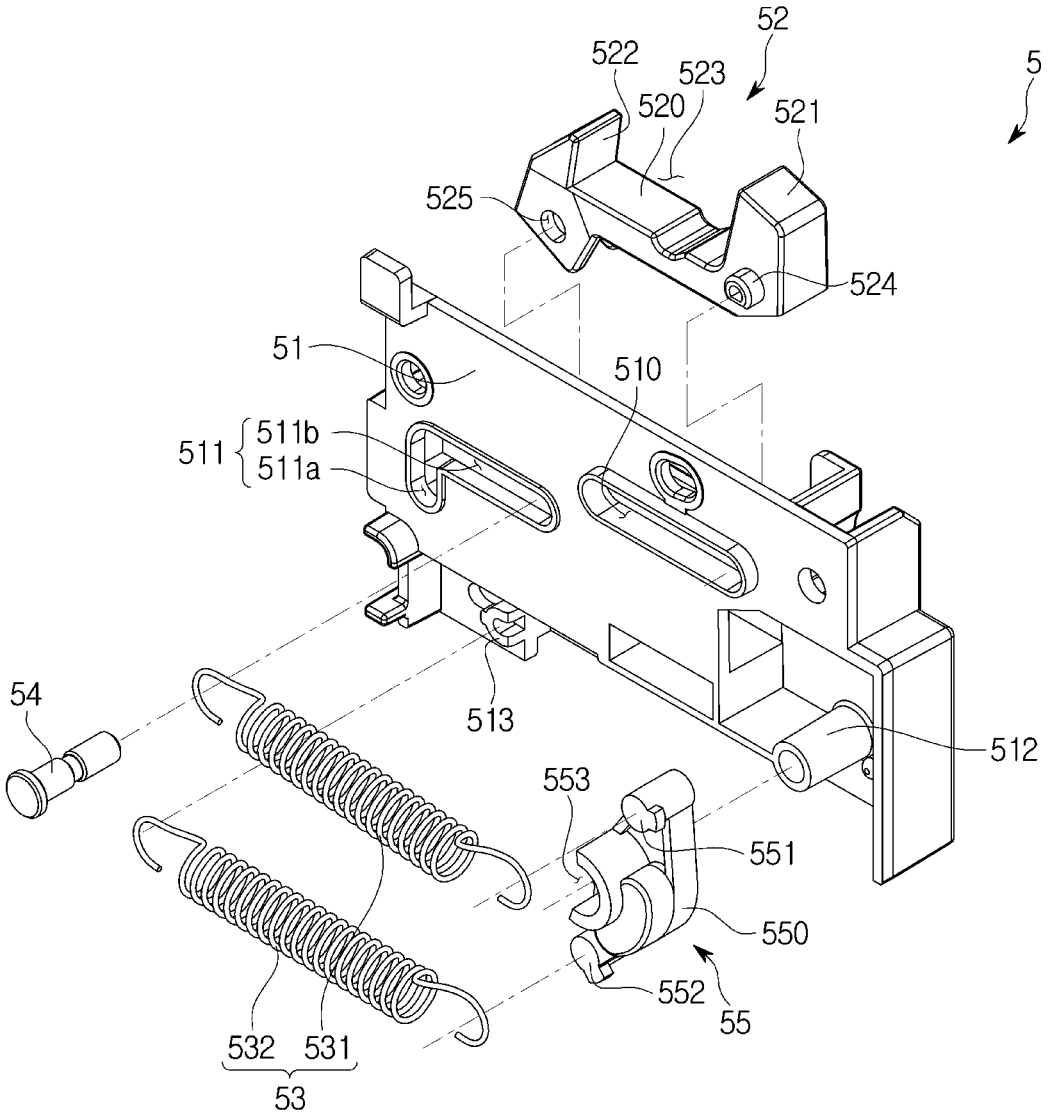

【FIG 9】
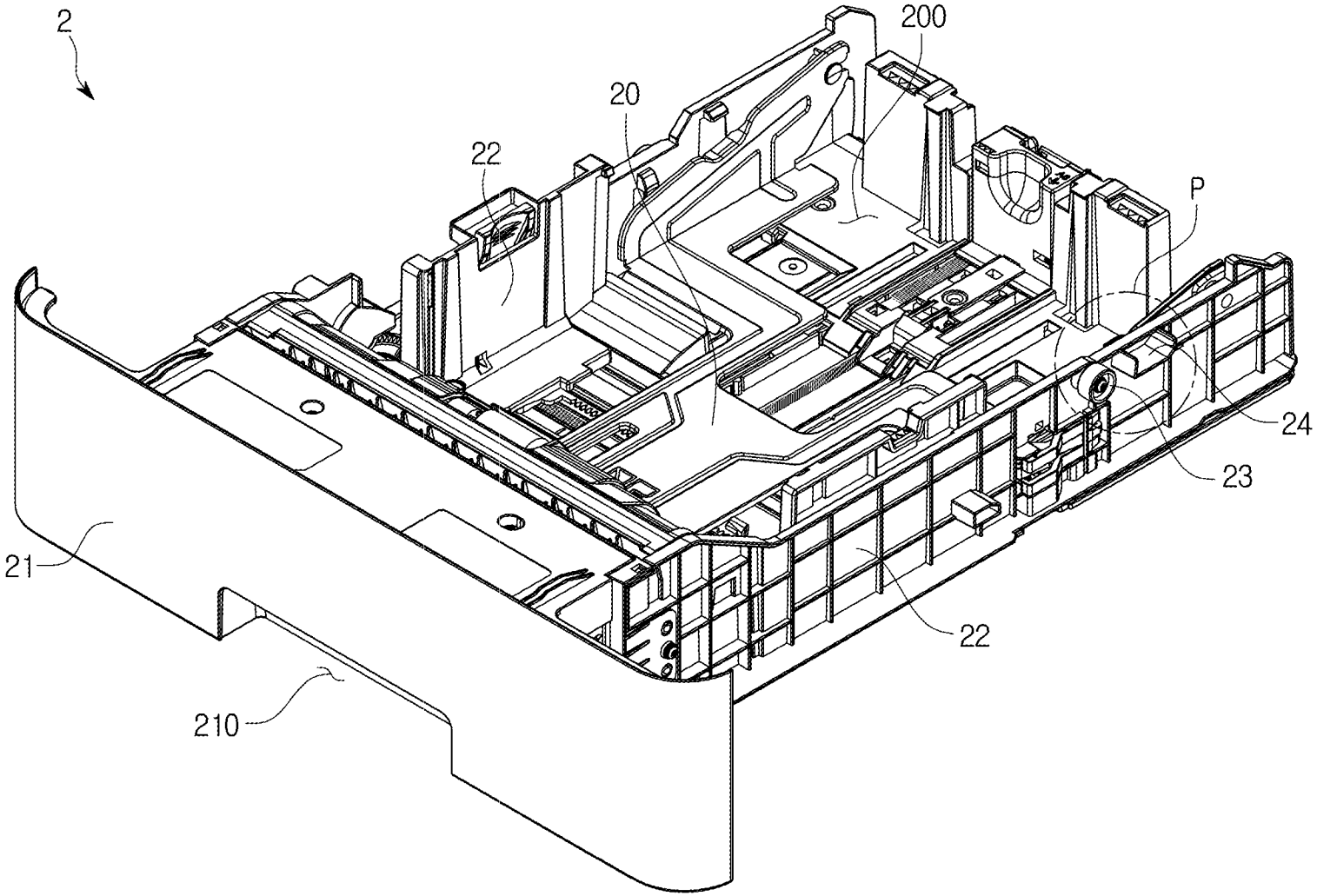

【FIG 10】
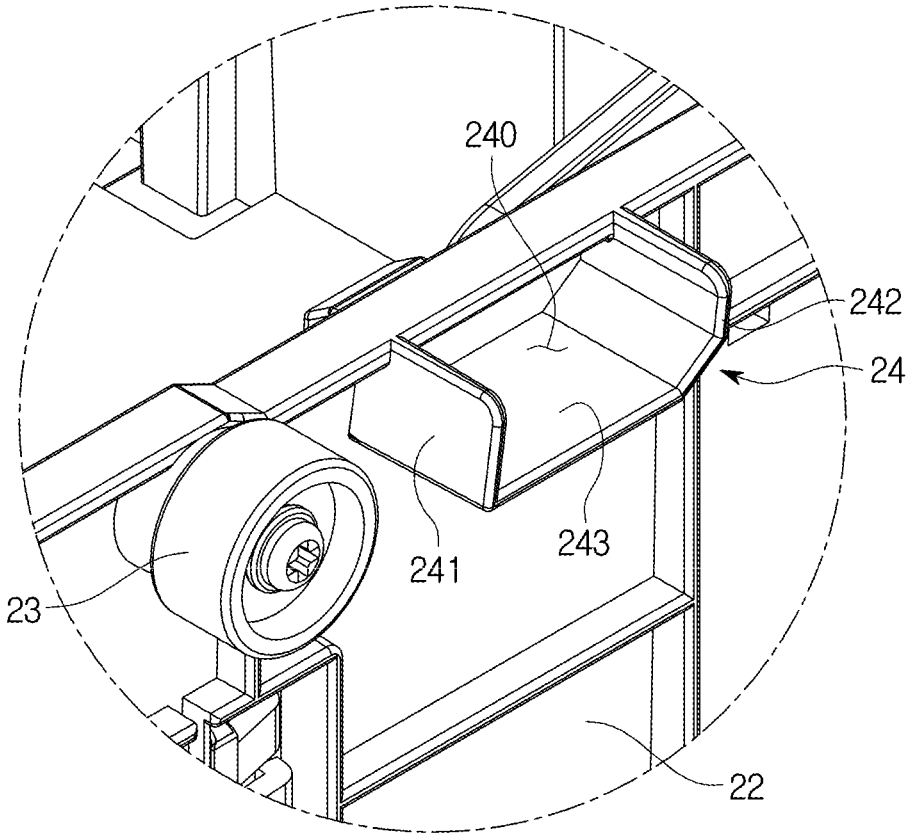

【FIG 11a】
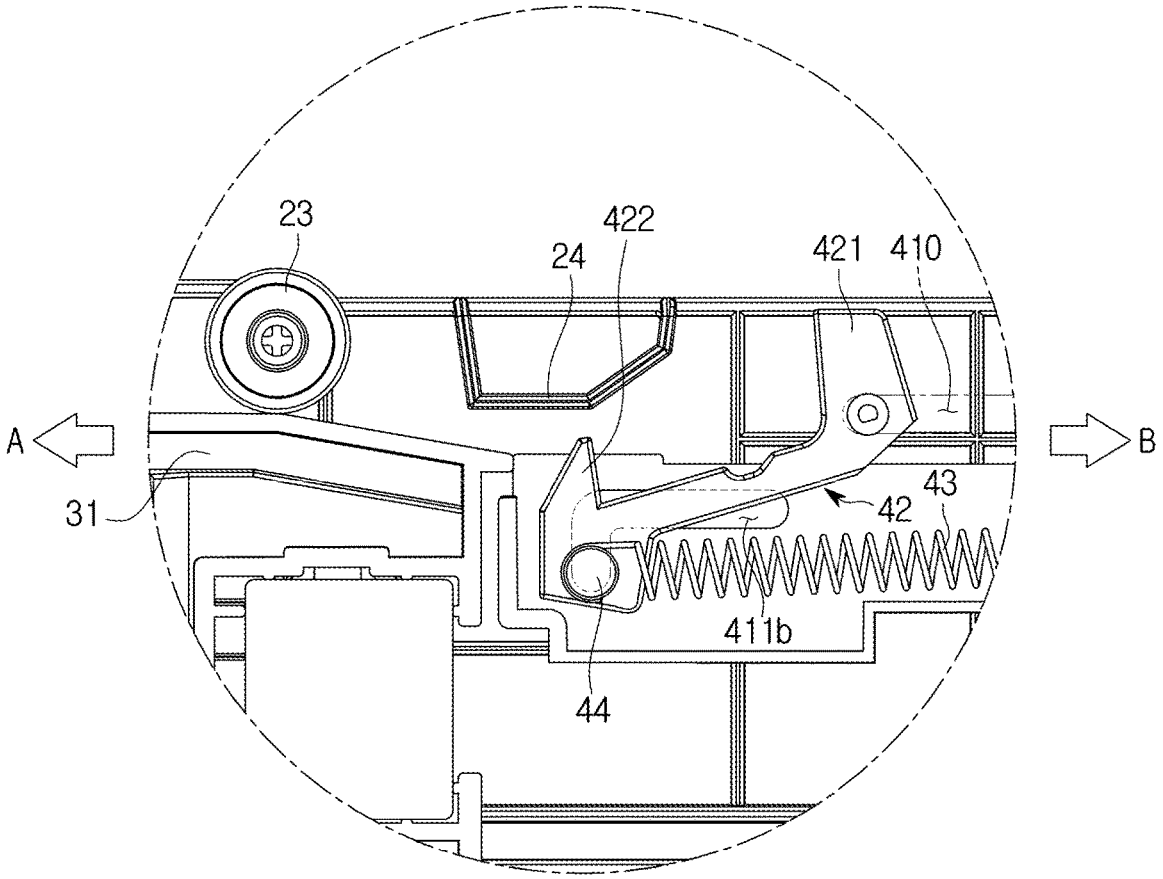

【FIG 11b】
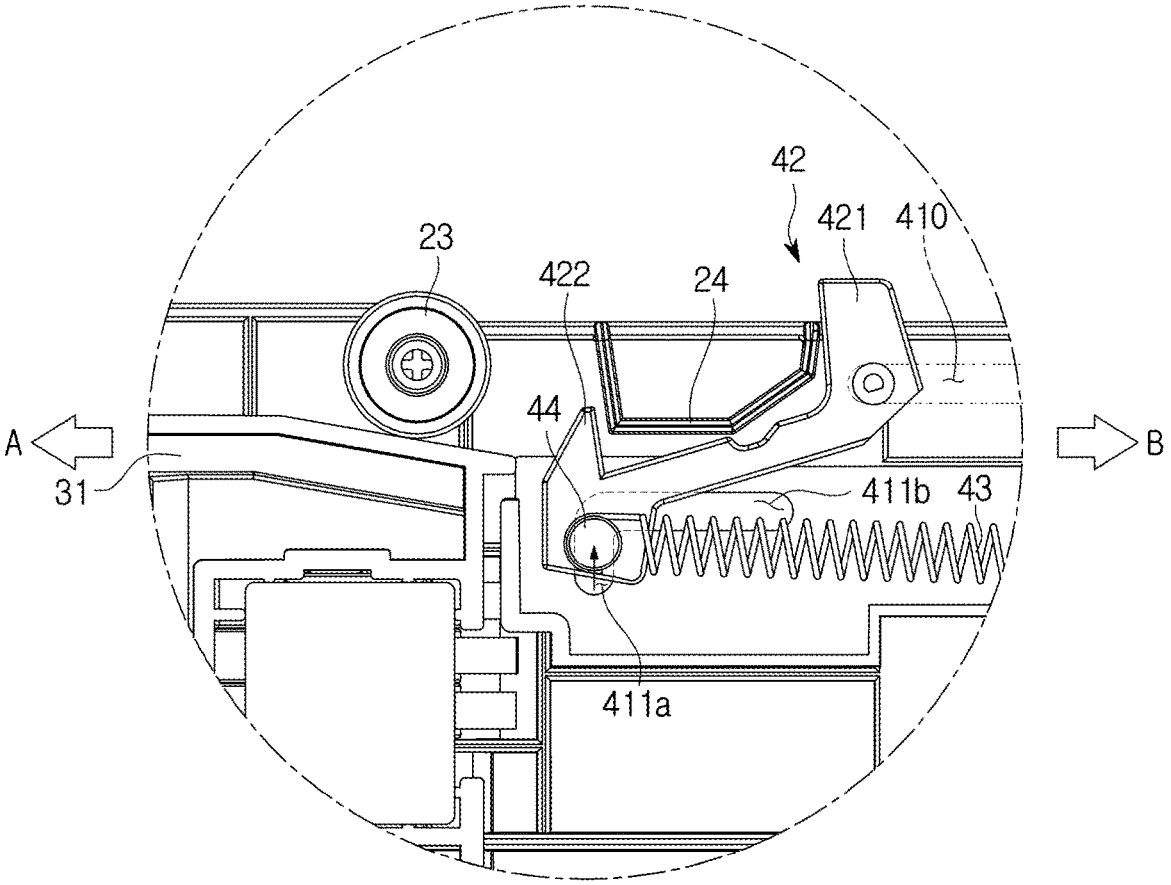

【FIG 11c】
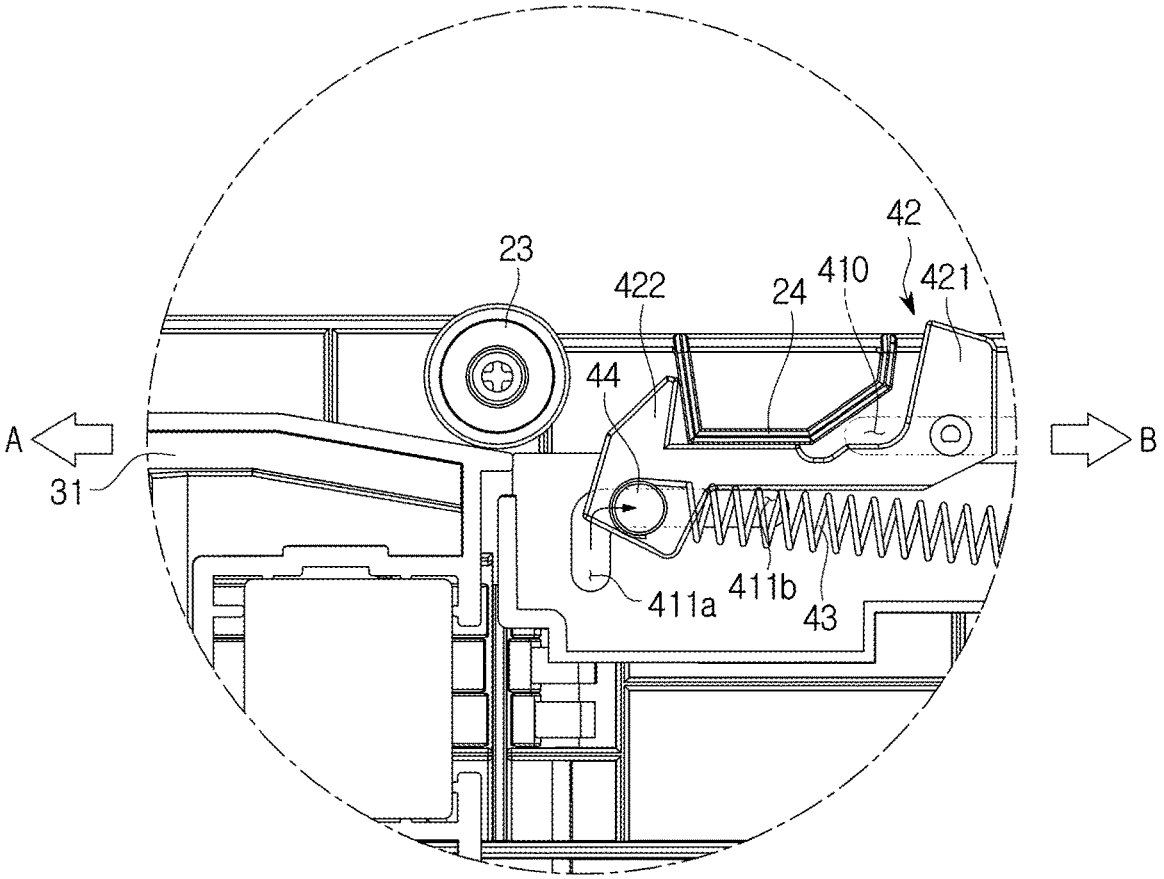

【FIG 12】
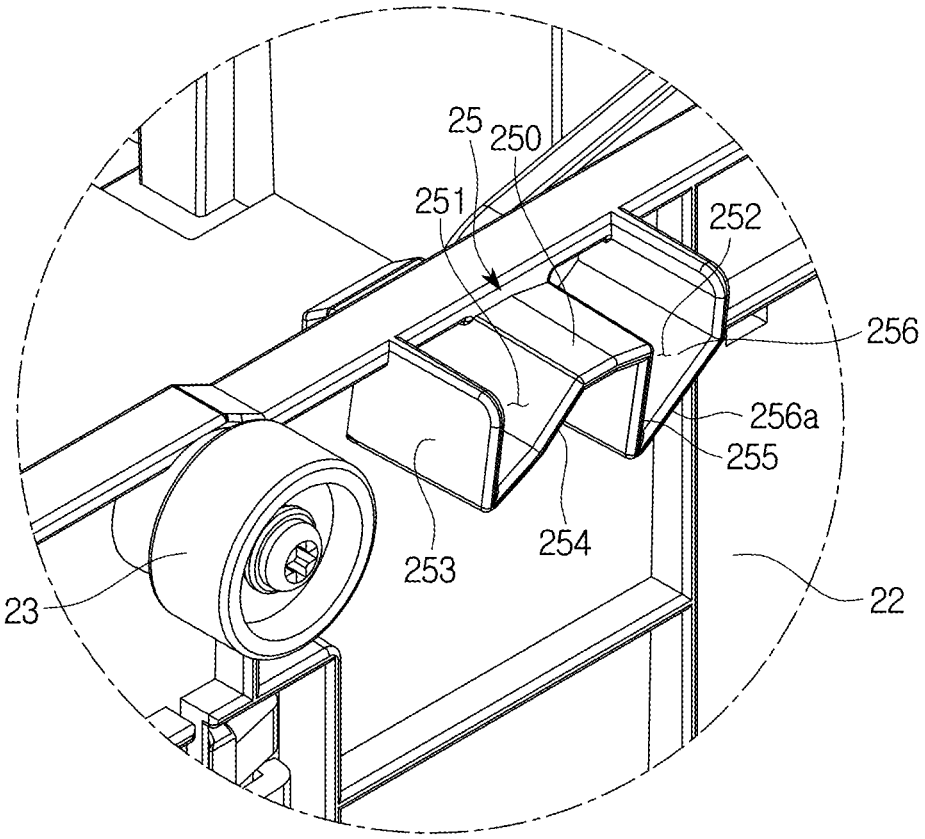

【FIG 13a】
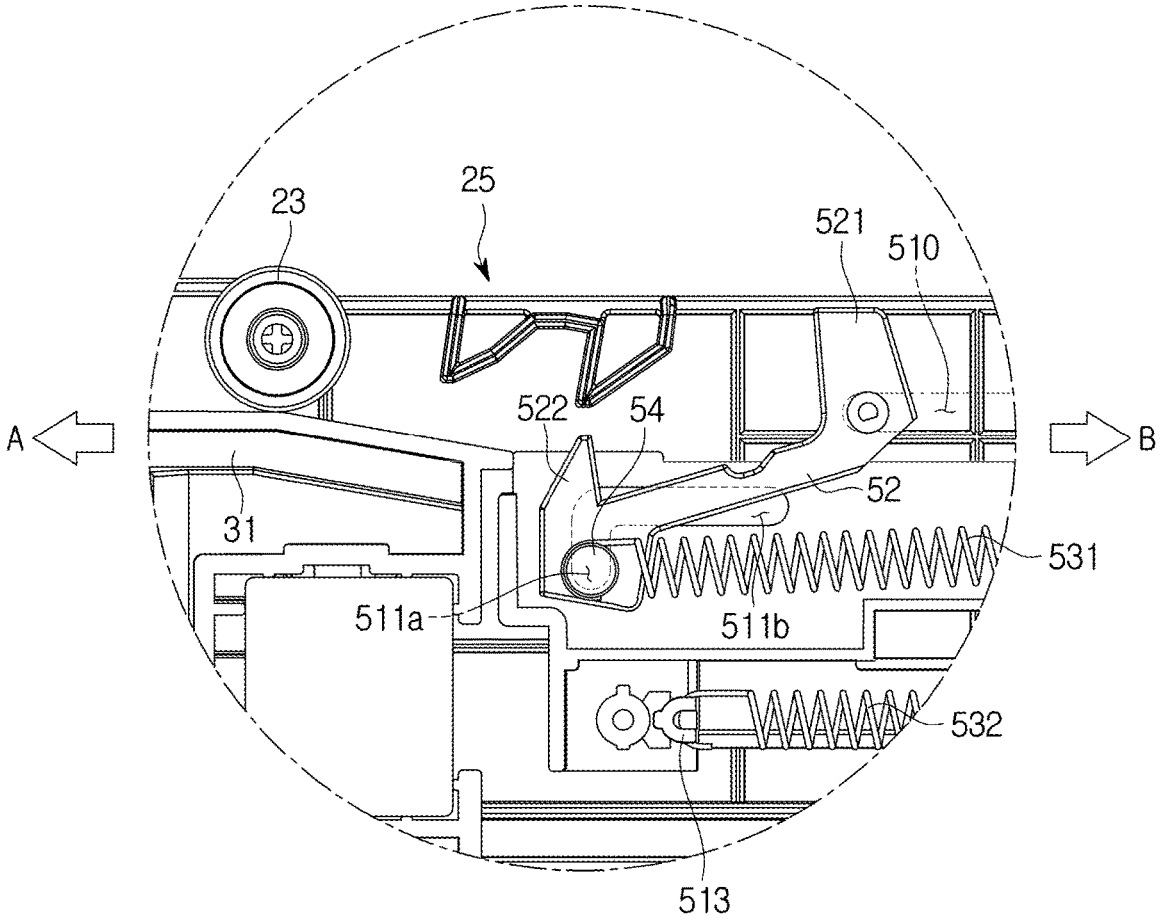

【FIG 13b】
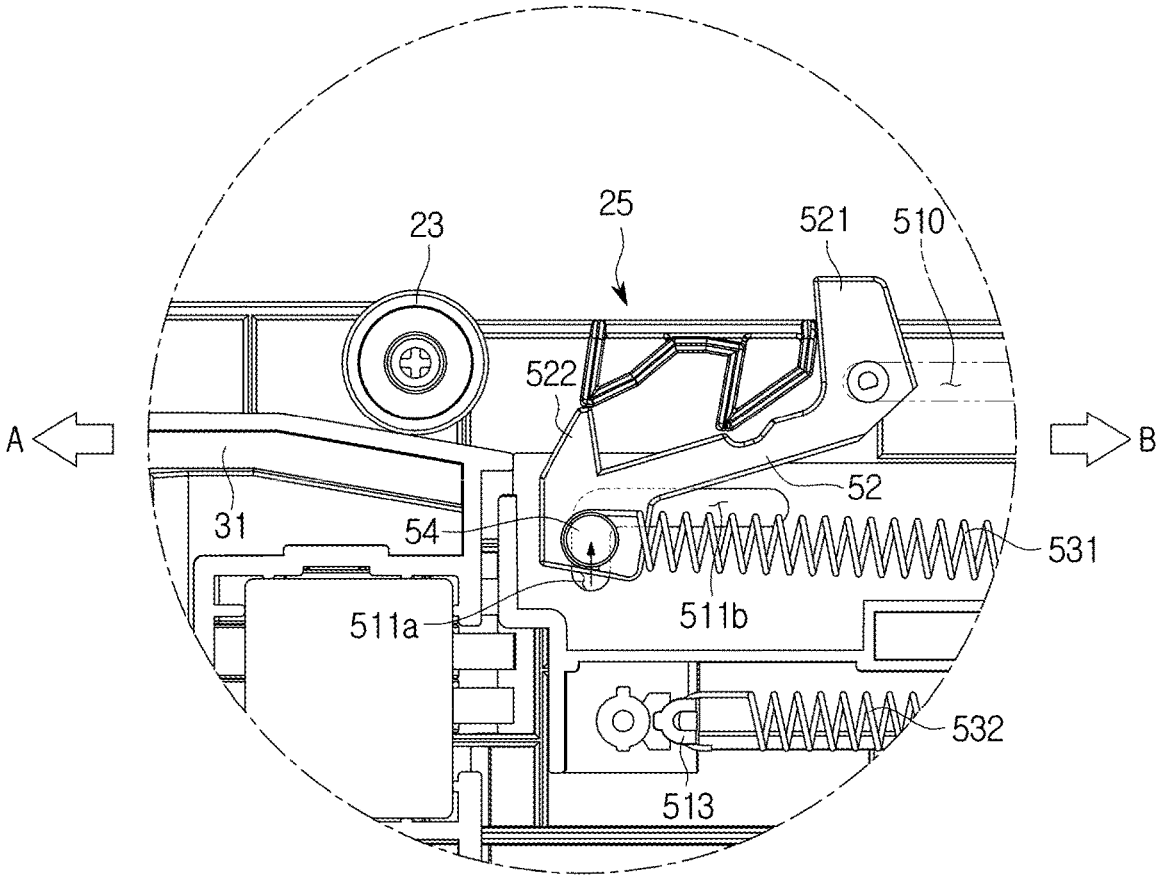

【FIG 13c】
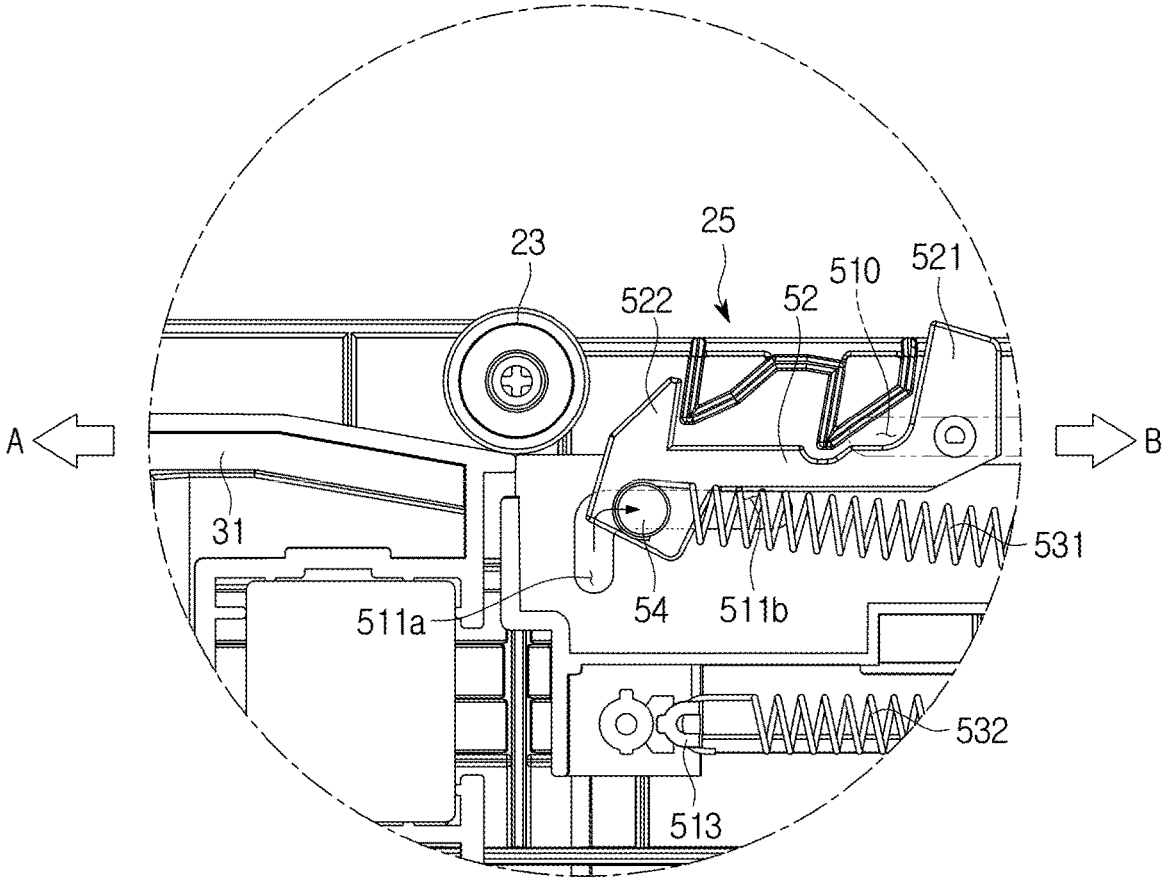

【FIG 14a】
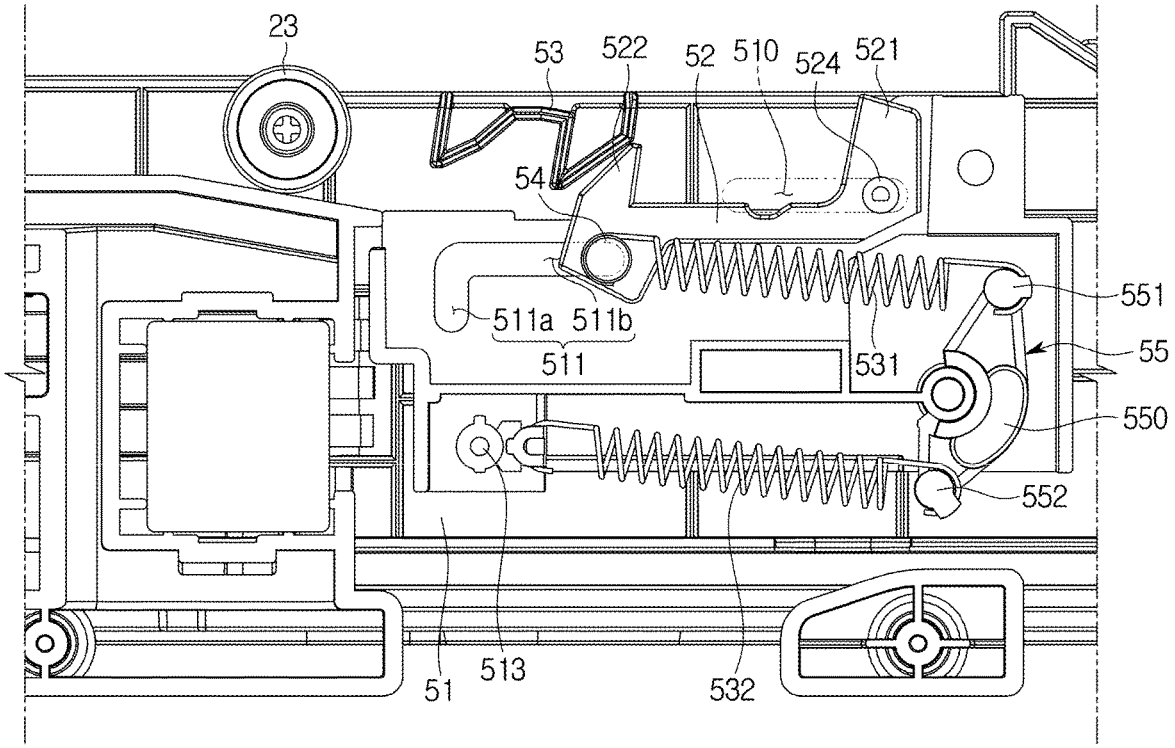

【FIG 14b】
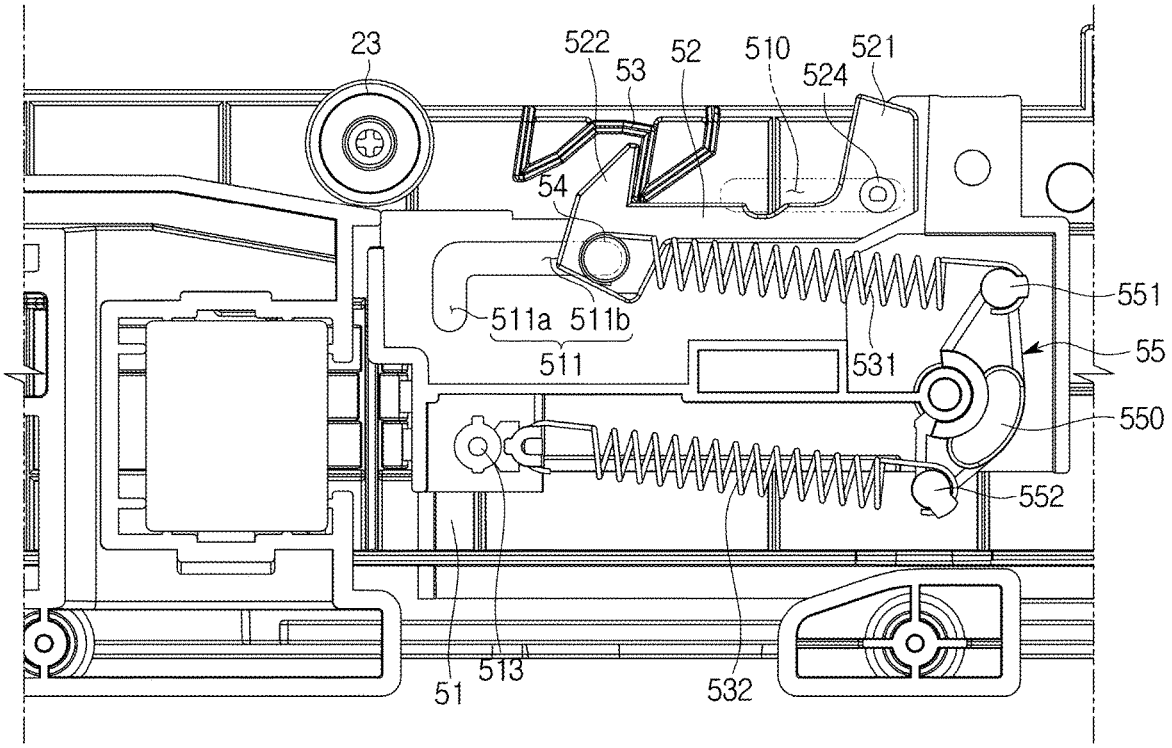

【FIG 14c】
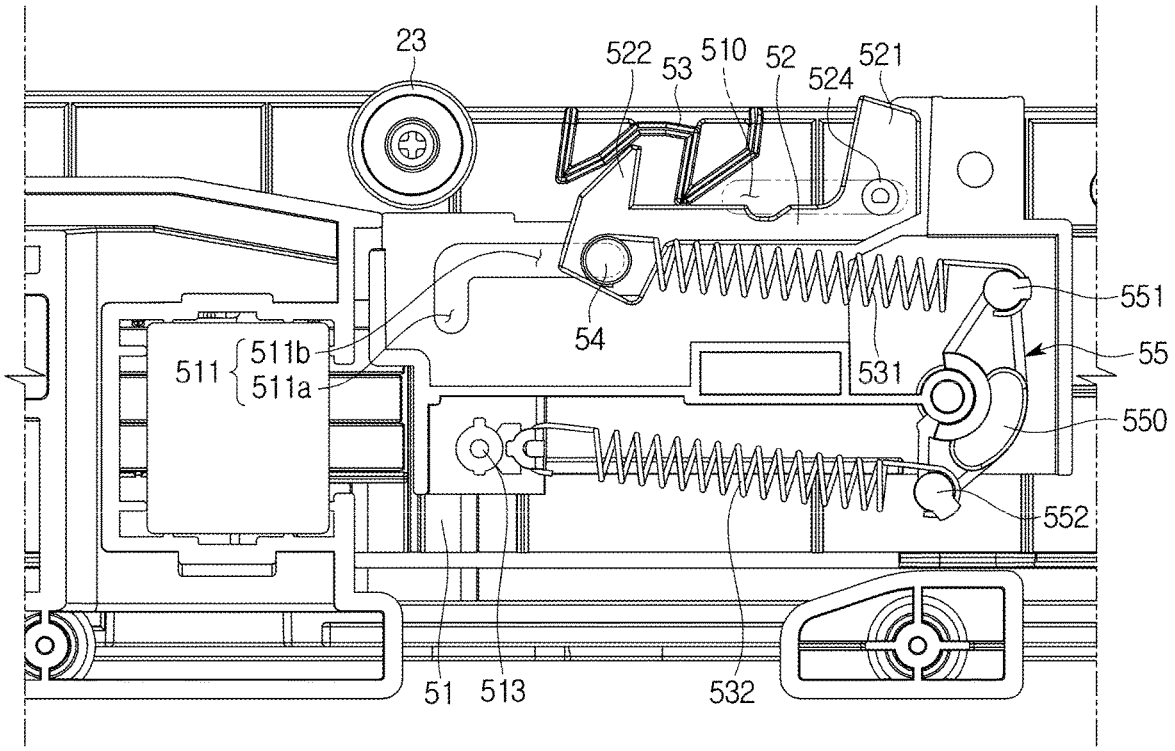

【FIG 14d】
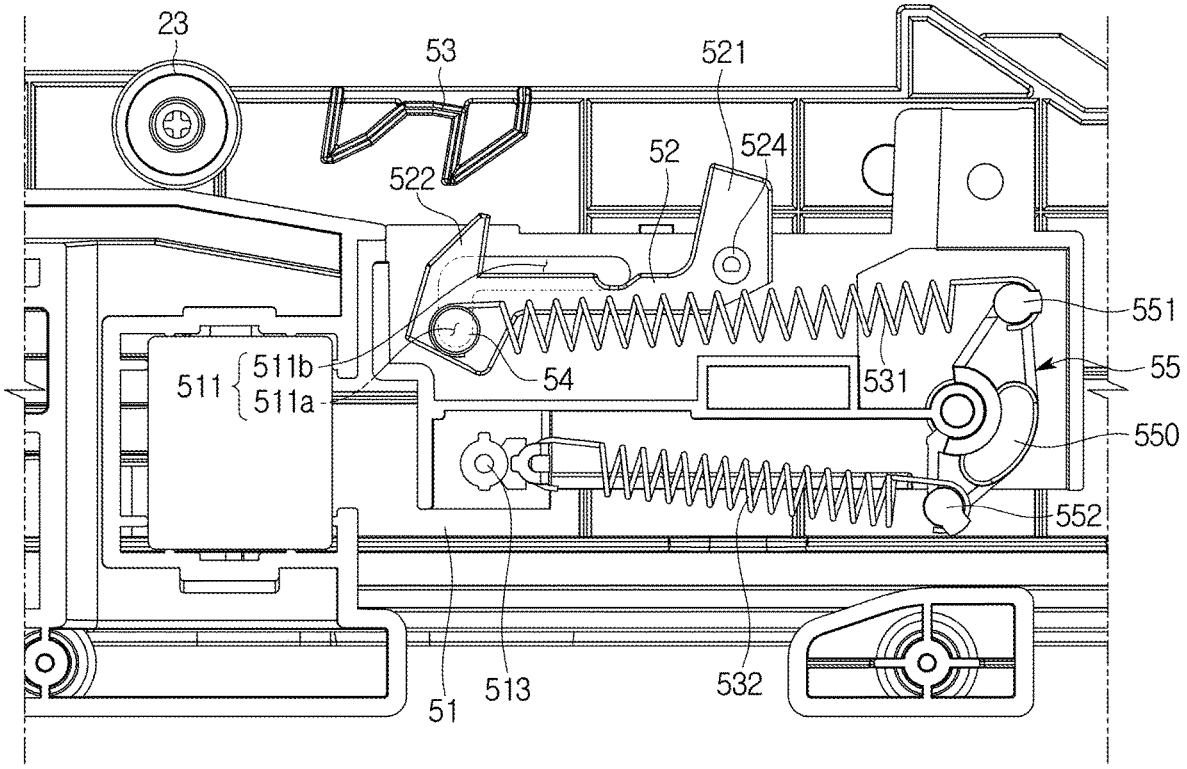

【FIG 15】
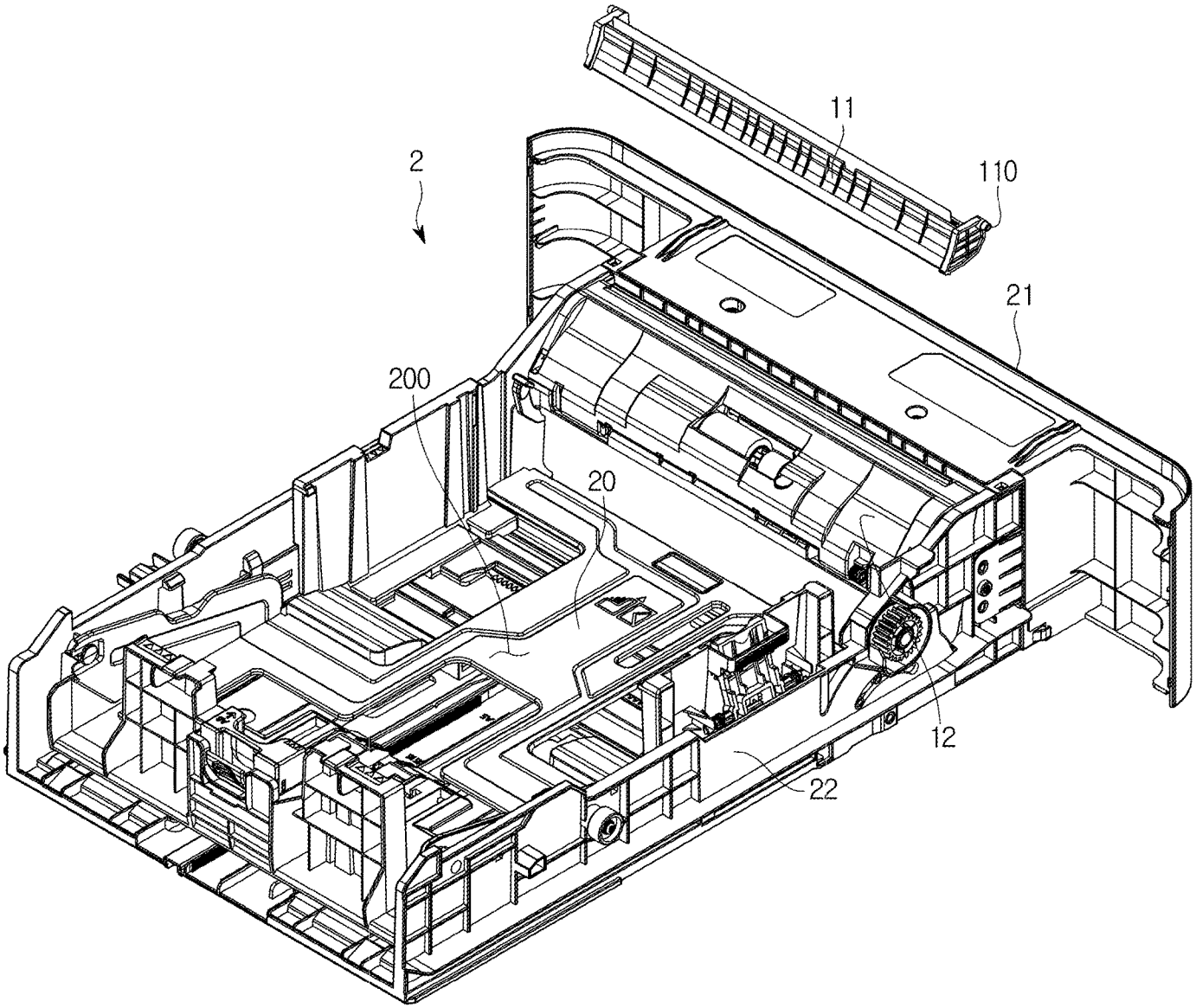

【FIG. 16】
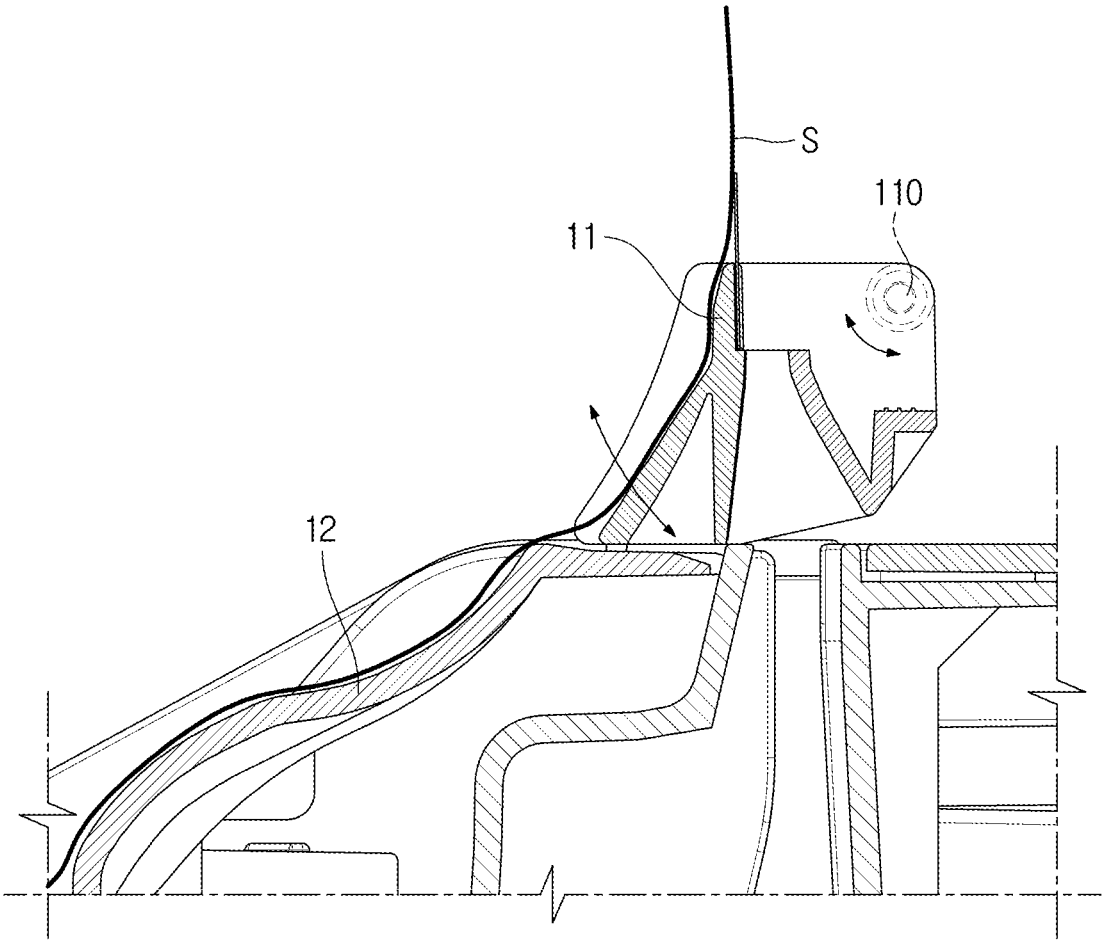

AUTOMATIC MOUNTING APPARATUS AND IMAGE FORMING APPARATUS INCLUDING SAME

CLAIM OF PRIORITY

This application claims the benefit of Korean Patent Application No. 10-2015-0099555, filed on Jul. 14, 2015, and International Patent Application No. PCT/KR2016/007371, filed on Jul. 7, 2016, the disclosures of which are incorporated herein in their entirety by reference.

BACKGROUND ART

An image forming apparatus is an apparatus for printing an image on print media, and comprises a printer, a copier, a facsimile, and a multifunction device in which functions of a printer, a copier, and a facsimile are combined.

An image forming apparatus adopting electrophotography forms a visible image by scanning light to a photosensitive member charged to a predetermined potential after forming an electrostatic latent image on the surface of the photosensitive member, and by supplying a toner to the electrostatic latent image. The visible image formed on the photosensitive member is directly transferred to a print medium or transferred to the print medium through an intermediate transfer member, and the visible image transferred to the print medium is fixed by a fixing device.

The image forming apparatus may be provided with a cassette on which a volume of the print medium is loaded. The cassette can be mounted on the image forming apparatus in a drawable manner. Since the cassette is inserted into the image forming apparatus while the print medium is loaded thereon, a cassette mounting device is formed of a rigid material so as to withstand the weight of the cassette and the print medium loaded on the cassette.

The cassette mounting device is provided with a damper to prevent the impact and noise generated when the cassette is inserted into the image forming apparatus.

DESCRIPTION OF DRAWINGS

These and/or other aspects of the present disclosure will become apparent and more readily appreciated from the following description of the examples, taken in conjunction with the accompanying drawings of which:

FIG. 1 is a view illustrating a configuration of an image forming apparatus according to an example.

FIG. 2 is a view illustrating an automatic mounting apparatus according to an example.

FIG. 3 is a perspective view illustrating a locking device according to an example.

FIG. 4 is a front view illustrating the locking device of FIG. 3 according to an example.

FIG. 5 is an exploded-perspective view illustrating the locking device of FIG. 3 according to an example.

FIG. 6 is a perspective view illustrating a locking device according to another example.

FIG. 7 is a front view illustrating the locking device of FIG. 6 according to another example.

FIG. 8 is an exploded-perspective view illustrating the locking device of FIG. 6 according to another example.

FIG. 9 is a perspective view illustrating the cassette of FIG. 1 according to an example.

FIG. 10 is a view illustrating a portion of the cassette of FIG. 9.

FIGS. 11A to 11C are views illustrating an operation in which the cassette of FIG. 9 is mounted automatically according to an example.

FIG. 12 is a view illustrating a portion of a cassette according to another example.

FIGS. 13A to 13C are views illustrating an operation in which the cassette of FIG. 12 is mounted automatically according to another example.

FIGS. 14A to 14D are views illustrating an operation when the cassette is erroneously mounted according to another example.

FIG. 15 is a view illustrating a configuration of a printing sheet outlet portion of the cassette according to an example.

FIG. 16 is a cross-sectional view illustrating the printing sheet outlet portion of the cassette according to an example.

DETAILED DESCRIPTION

Hereinafter examples of an automatic mounting apparatus and an image forming apparatus having the same will be described in details with reference to drawings.

FIG. 1 is a view illustrating a configuration of an image forming apparatus according to an example.

In FIG. 1, an image forming apparatus 1 may comprise a housing 10, and a cassette 2 on which printing sheets are loaded for storing and feeding. An opening 10*a* may be formed at the front side of the housing 10, and the cassette 2 may be inserted into or pulled out from the image forming apparatus 1 via the opening 10*a*.

The image forming apparatus 1 comprises a developing device forming an image on a printing sheet S supplied via the cassette 2, a toner device supplying the toner to the developing device, a light scanning device forming an electrostatic latent image on a photosensitive member in the developing device, a fixing device fixing the toner image transferred on the printing sheet S, and a discharging device discharging the printing sheet S on which formation of the image is completed, to the outside of the housing 10.

On the cassette 2, the printing sheet S may be loaded. The cassette 2 is provided at a lower portion of the housing 10 in the drawable manner to supply the printing sheet S to the developing device. The printing sheet S loaded on the cassette 2 is picked up one by one by a pick-up portion and then transferred to the developing device by a feeding port.

The developing device comprises a photosensitive member forming an electrostatic latent image, an agitating screw agitating the toner supplied from the toner device, a developing roller supplying the toner agitated by the agitating screw, to the photosensitive member, and a charging member charging the photosensitive member. The toner supplied from the toner device is supplied to the photosensitive member by the developing roller to form a visible image. The photosensitive member forms a transfer nip (N1) by making contact with a transfer roller so that the toner forming the visible image, which is supplied to the photosensitive member, is transferred to the printing sheet S.

The light scanning device forms an electrostatic latent image on the photosensitive member by scanning the light comprising image information to the photosensitive member. The fixing device fixes the toner image, which is formed on the printing sheet S, by applying the heat and pressure, to the printing sheet S. The printing sheet S passed through the fixing device may be discharged to the outside of the housing 10 by the discharging device.

FIG. 2 is a view illustrating an automatic mounting apparatus 100 according to an example.

In FIG. 2, the automatic mounting apparatus 100 comprises a rail assembly 3 and a locking device 4. The rail assembly 3 may be mounted to an inner wall of the housing 10 in which the cassette 2 is accommodated. The locking device 4 may be mounted to the rail assembly 3.

The rail assembly 3 comprises a rail frame 30 mounted to the inner wall of the housing 10 of the image forming apparatus 1. A rail portion 31 guiding the movement of the cassette 2 may be provided on one surface of the rail frame 30. When the cassette 2 is inserted into the housing 10 from the front side to the rear side of the housing 10, the rail frame 30 may be disposed to allow the rail portion 31 to extend in the front and rear direction. The movement of the cassette 2 may be guided by the rail portion 31 extended in the front and rear direction. The cassette 2 may be inserted into the housing 10 by moving from A direction, which is toward the front side, to B direction, which is toward the rear side.

At least one portion of the rail portion 31 placed in the rear side may be inclined so that a rear end portion is formed downward. When it is assumed that the rail portion 31 is divided into a front portion S1 and a rear portion S2, the rear portion S2 may be gradually lowered from a portion in which the front portion S1 and the rear portion S2 are connected, to its end portion. The end portion of the rear portion S2 of the rail portion 31 is formed to be lower than the front portion S1. Therefore, a height difference H1 is present between the end portion of the rear portion S2 and the front portion S1 of the rail portion 31. This height difference H1 may be approximately 4.5 mm. The length of the rear portion S2 may be approximately 25 mm.

Since the rear portion S2 of the rail portion 31 is inclined, the cassette 2 may be inserted into the housing 10 by being guided along the rail portion 31 and accelerated by sliding on the rear portion S2. The cassette 2 may be accessed to the locking device 4 by a force greater than the force applied to the cassette 2 due to the thrust.

An idle roller 32 may be provided in one side of the rail frame 31 so that the cassette 2 is softly inserted into or pulled out.

The locking device 4 may be disposed on the rear side of the rail portion 31. The locking device 4 may be adjacent to the rear portion S2 of the rail portion 31. The cassette 2, which is moved from the front side A to the rear side B by being guided by the rail portion 31, may be locked by the locking device 4.

FIG. 3 is a perspective view illustrating the locking device 4 of FIG. 2 according to an example, FIG. 4 is a front view illustrating the locking device 4 of FIG. 2 according to an example, and FIG. 5 is an exploded-perspective view illustrating the locking device 4 of FIG. 2 according to an example.

Referring to FIGS. 3 to 5, according to an example, the locking device 4 may comprise a case 41 mounted to the rail portion 31, a locking lever 42 movably mounted on the case 41 and an elastic member 43 transferring the elastic force to the locking lever 42.

A first hole 410 extended in the front and rear direction and a second hole 411 provided in the bent shape may be formed in the case 41. The first hole 410 and the second hole 411 may be spaced apart from each other by a predetermined distance.

The second hole 411 may comprise a locking hole 411*a* extended in the vertical direction and a sliding hole 411*b* extended in the front and rear direction. The locking hole 411*a* may be disposed more toward the front side (A direction) than the sliding hole 411*b*. The locking hole 411*a* and the sliding hole 411*b* are connected to form a single hole. The locking hole 411*a* may have any shape as long as it is bent downward (D direction) from the sliding hole 411*b* without extending in the vertical direction. The sliding hole 411*b* may be extended in parallel with the first hole 410.

The locking lever 42 may comprise a body 420, an interference portion 421 bent from one end portion of the body 420, and a pressing portion 422 bent from the other end portion of the body 420. The interference portion 421 and the pressing portion 422 may be provided to face upward (C direction). When the automatic mounting apparatus 100 is installed in the housing 10, the interference portion 421 may be positioned back of the pressing portion 422. An engaging portion 24 and 25 provided on the side surface of the cassette 2, as will be illustrated in FIGS. 9 and 12, may be placed in an accommodation portion 423 formed by the body 420, the interference portion 421 and the pressing portion 422.

In the locking lever 42, a protrusion 424 inserted into the first hole 410 formed in the case 41 may be formed to protrude. The protrusion 424 may move along the first hole 410. The protrusion 424 may be provided on the side of the interference portion 421.

The locking lever 42 may be provided with a pin insertion hole 425 to which a pin 44 is inserted and mounted. The pin 44 may be inserted into the second hole 411 formed in the case 41 and movable along the second hole 411.

In the above, it has been described that the protrusion 424 provided in the locking lever 42 is inserted into the first hole 410 and the pin 44 mounted to the pin insertion hole 425 is inserted into the second hole 411. However, instead of the protrusion 424 inserted into the first hole 410, the pin may be mounted or the protrusion protruding in the locking lever 42 may be moved along the second hole 411.

One side of the elastic member 43 may be fixed to the case 41 and the other side thereof may be fixed to the locking lever 42. The case 41 may be provided with an elastic member fixing portion 412 on which one side of the elastic member 43 is mounted. The other side of the elastic member 43 may be fixed to the pin 44 mounted on the locking lever 42. The elastic member 43 may provide the elastic force so that the locking lever 42 moves from the front side A to the rear side B.

FIG. 6 is a perspective view illustrating a locking device 5 according to another example, FIG. 7 is a front view illustrating the locking device 5 of FIG. 6, and FIG. 8 is an exploded-perspective view illustrating the locking device 5 of FIG. 6.

In FIGS. 6 to 8, the locking device 5 may comprise a case 51, a locking lever 52 and an elastic member 53. The locking device 5 may comprise a plurality of elastic members. For example, two elastic members may be provided. The two elastic members may be mounted on a link 55 which is pivotally provided.

A first hole 510 extended in the front and rear direction and a second hole 511 provided in the bent shape may be formed in the case 51. The first hole 510 and the second hole 511 may be spaced apart from each other by a predetermined distance.

The second hole 511 may comprise a locking hole 511*a* extended in the vertical direction and a sliding hole 511*b* extended in the front and rear direction. The locking hole 511*a* may be disposed more toward the front side (A direction) than the sliding hole 511*b*. The locking hole 511*a* and the sliding hole 511*b* are connected to form a single hole. The locking hole 511*a* may have any shape as long as it is bent downward (D direction) from the sliding hole 511*b* without extending in the vertical direction. The sliding hole 511*b* may be extended in parallel with the first hole 510.

The locking lever 52 may comprise a body 520, an interference portion 521 bent from one end portion of the body 520, and a pressing portion 522 bent from the other end portion of the body 520. The interference portion 521 and the pressing portion 522 may be provided to face upward (C direction). When the automatic mounting apparatus 100 is installed in the housing 10, the interference portion 521 may be positioned back of the pressing portion 522. The engaging portion 24 and 25 provided in the side surface of the cassette 2 may be placed in an accommodation portion 523 formed by the body 520, the interference portion 521 and the pressing portion 522.

In the locking lever 52, a protrusion 524 inserted into the first hole 510 formed in the case 51 may be formed to protrude. The protrusion 524 may be movable along the first hole 510. The protrusion 524 may be provided on the side of the interference portion 521.

The locking lever 52 may be provided with a pin insertion hole 525 to which a pin 54 is inserted and mounted. The pin 54 may be inserted into the second hole 511 formed in the case 51 and movable along the second hole 511.

In the above, it has been described that the protrusion 524 provided in the locking lever 52 is inserted into the first hole 510 and the pin 54 mounted to the pin insertion hole 525 is inserted into the second hole 511. However, instead of the protrusion 524 inserted into the first hole 510, the pin may be mounted, or the protrusion protruding in the locking lever 52 may be moved along the second hole 511.

The elastic members 53 may comprise a first elastic member 531 and the second elastic member 532. One side of the first elastic member 531 and one side of the second elastic member 532 may be fixed to a single link 55. The link 55 may be pivotable about a rotation protrusion 512 protruding from the case 51.

The link 55 may comprise a body portion 550 to which the elastic member 53 is mounted, and a rotation protrusion inserting portion 553 formed in the body portion 550 and configured to surround at least one portion of the rotation protrusion 512. The first elastic member 531 may be fixed to one end portion of the body portion 550 and the second elastic member 532 may be fixed to the other end portion of the body portion 550. The body portion 550 may be disposed to extend substantially vertically so that the first elastic member 531 is positioned at the upper side of the second elastic member 532.

The other side of the elastic member 531 may be fixed to the locking lever 52. For example, the first elastic member 531 may be fixed to the pin 54 mounted on the locking lever 52. The first elastic member 531 may provide the elastic force so that the locking lever 52 moves from the front side (A direction) to the rear side (B direction).

The other end of the second elastic member 532 may be mounted to an elastic member fixing portion 513 provided in the case 51. The elastic member fixing portion 513 may be positioned in the lower side of the second hole 511. The second elastic member 532 may provide the elastic force to the link 55 in the direction of pulling the other end of the link 55. The elastic force of the second elastic member 532 is transmitted to the locking lever 52 through the link 55, and thus the locking lever 52 may be moved from the front side (A direction) to the rear side (B direction) by receiving the elastic force larger than a case in which only the first elastic member 531 is provided.

FIG. 9 is a perspective view illustrating the cassette 2 of FIG. 1 according to an example, and FIG. 10 is a view illustrating a portion of the cassette of FIG. 9.

In FIGS. 9 and 10, the cassette 2 may be provided with an accommodation portion 200 on which the printing sheet S is loaded. The cassette 2 may comprise a bottom surface 20 and a side surface 22 connected to the bottom surface 20. The side surfaces 22 may be provided at opposite corners of the bottom surface 20, respectively.

A front cover 21 may be provided in the front side of the cassette 2. The front cover 21 may be provided with a handle 210. The user can insert the cassette 2 into or pull the cassette 2 out from the image forming apparatus 1 by holding the handle 210. The handle 210 may be formed such that a part of the front cover 21 is cut out.

The engaging portion 24 interfered with the locking lever 42 and 52 may be provided on the side surface 22. The engaging portion 24 may be formed in a rib shape protruding from the side surface 22. The engaging portion 24 may comprise a first engaging portion 241 protruding from the side surface 22, a second engaging portion 242 protruding from the side surface 22 and being spaced apart from the first engaging portion 241 by a predetermined distance, and a connecting portion 243 connecting one end portion of the first engaging portion 241 to one end portion of the second engaging portion 242. The connecting portion 243 may be provided to connect the lower end portion of the first engaging portion 241 to the lower end portion of the second engaging portion 242. The first engaging portion 241 may be positioned ahead of the second engaging portion 242.

An idle roller 23 may be provided on the side surface 22 of the cassette 2. When the cassette 2 is inserted into or pulled out from the image forming apparatus 1, the idle roller 23 may be moved along the rail frame 31 in a sliding manner. Since the idle roller 23 is provided to move along the rail frame 31, the cassette 2 may be softly inserted into or pulled out. The idle roller 23 may be provided on opposite side surfaces of the cassette 2.

Hereinafter, a description is provided to illustrate an operation in which the cassette 2 is mounted automatically. For convenience, FIGS. 11A to 110 illustrate a case in which the image forming apparatus 1 is provided with the locking device 4 according to an example shown in FIGS. 3 to 6.

FIGS. 11A to 11C are views illustrating the operation in which the cassette 2 is mounted automatically according to an example.

Referring to FIGS. 11A to 110, the cassette 2 may be moved from the front side (A) to the rear side (B) in the sliding manner and then inserted into the inside of the housing 10. The idle roller 23 provided in the side surface 22 of the cassette 2 may be slid along the rail portion 31. The engaging portion 24 may be positioned ahead of the idle roller 23 and then moved together with the cassette 2.

When the idle roller 23 reaches to the inclined rear portion S2 by passing through the front portion S1 of the rail portion 31 (refer to FIG. 2), the idle roller 23 may be accelerated due to the weight of the cassette 2 and then moved to the locking lever 42 positioned ahead of the rail portion 31. Before the engaging portion 24 makes contact with the locking lever 42, the pin 44 may be positioned in the locking hole 411*a* of the second hole 411. The pin 44 may be positioned lower than the sliding hole 411*b* so that the pressing portion 422 of the locking lever 42 in which the pin 44 is provided is positioned to avoid the interference of the engaging portion 24.

When the cassette 2 is slid, the second engaging portion 242 may be interfered with the interference portion 421 of the locking lever 42. The pin 44 may move along the locking hole 411*a* and be positioned in the sliding hole 411*b*.

When the pin 44 is positioned in the sliding hole 411*b*, the pin 44 may be moved to the rear side (B) along the sliding hole 411*b* by the elastic force of the elastic member 43. The locking lever 42 to which the pin 44 is mounted may move in the rear side (B) together with the cassette 2. The protrusion 424 of the locking lever 42 may slide along the first hole 410 in the front and rear direction. The engaging portion 24 is positioned in the accommodation portion 423 located between the interference portion 421 and the pressing portion 422. Since the first engaging portion 241 is pressed by the pressing portion 422 of the locking lever 42, the first engaging portion 241 may be prevented from moving into the rear side as long as the external force is not applied. Accordingly, the cassette 2 may be inserted into and mounted to the housing 10.

When the cassette 2 is inserted into the cassette 2, the cassette 2 is lowered by a certain height just before being mounted to the housing 10, since the rear portion S2 of the rail portion 31 is inclined. Therefore, the cassette 2 may be automatically mounted to the housing 10 by the force generated when the cassette 2 is lowered, and the elastic force of the elastic member 43. Since the cassette 2 is configured to be automatically mounted by the rail portion 31 having a height difference and by the elastic member 43, it may be possible to omit the configuration, e.g., a damper, and thus it may be possible to reduce the manufacturing cost of the image forming apparatus 1. Since the cassette 2 is mounted to the housing 10 by using the weight of the cassette 2, it may be possible to insert the cassette 2 into the housing 10 with a small force so as to improve the user experience.

A user may pull out the cassette 2 from the housing 10 at the front side (A). The first engaging portion 241 may press the pressing portion 422 of the locking lever 42, and the cassette 2 together with the locking lever 42 may be slid into the front side (A). The pin 44 may be moved along the sliding hole 411*b*, and when the pin 44 reaches the locking hole 411*a*, the pin 44 may be moved into the locking hole 411*a*. When the pin 44 is moved into the locking hole 411*a*, the pressure applied to the first engaging portion 241 by the pressing portion 422 of the locking lever 42 may be released. When the first engaging portion 241 is released, the cassette 2 may be pulled out from the front side. During this operation, the idle roller 23 may be slid along the rail portion 31.

FIG. 12 is a view illustrating a portion of the cassette 2 according to another example.

In FIG. 12, an engaging portion 25 provided in the cassette 2 has a shape different from the shape of the engaging portion 24 as illustrated in FIGS. 9 and 10. The engaging portion 25 may be provided in a substantially W shape. The engaging portion 25 may protrude from the side surface of the cassette 2.

The engaging portion 25 may comprise a first engaging portion 253 and a second engaging portion 256, wherein the first engaging portion 253 and the second engaging portion 256 protrude on the side surface of the cassette 2 and spaced apart from each other by a predetermined distance. The first engaging portion 253 may be positioned ahead of the second engaging portion 256. The first engaging portion 253 and the second engaging portion 256 may be connected by connecting portions.

The connecting portions may comprise a first connecting portion 254 extending from the lower end of the first engaging portion 253 to the rear upper portion, a second connecting portion 255 extending from the lower end of the second engaging portion 256 to the front upper portion, and a third connecting portion 250 connecting the first connecting portion 254 to the second connecting portion 255. As needed, the third connecting portion 250 may be omitted and thus the first connecting portion 254 and the second connecting portion 255 may be directly connected to each other.

By the shape of the connecting portion 250, 254 and 255, the engaging portion 25 may comprise a first concave portion 251 formed by the first engaging portion 253 and the first connecting portion 254, and a second concave portion 252 formed by the second engaging portion 256 and the second connecting portion 255. The second engaging portion 256 may be provided with an inclined surface 256*a*. The inclined surface 256*a* may be provided to extend from the rear upper side to the front lower side.

Hereinafter a description is provided to illustrate an operation in which the cassette 2 of FIG. 12 is mounted automatically in accordance with another example. FIGS. 13A to 14D illustrate the cassette 2 of FIG. 12 inserted into or pulled out from the image forming apparatus 1 to which the locking device 4 shown in FIGS. 7 and 8 is applied.

FIGS. 13A to 13C are views illustrating the operation in which the cassette 2 of FIG. 12 is mounted automatically according to another example. In FIGS. 13A to 13C, when the cassette 2 is inserted into or pulled out from the housing 10 normally, the cassette 2 may be operated in a way similar with the cassette 2 as illustrated in FIGS. 11A to 11C.

Particularly, the cassette 2 may be moved from the front side (A) to the rear side (B) in the sliding manner and then inserted into the inside of the housing 10. The idle roller 23 provided in the side surface 22 of the cassette 2 may be slid along the rail portion 31. The engaging portion 25 may be positioned ahead of the idle roller 23 and then moved together with the cassette 2.

When the idle roller 23 reaches to the inclined rear portion S2 by passing through the front portion S1 of the rail portion 31 (refer to FIG. 2), the idle roller 23 may be accelerated due to the weight of the cassette 2 and then moved to the locking lever 52 positioned ahead of the rail portion 31. Before the engaging portion 25 makes contact with the locking lever 52, the pin 54 may be positioned in the locking hole 511*a* of the second hole 511. The pin 54 may be positioned lower than the sliding hole 511*b* so that the pressing portion 522 of the locking lever 52 in which the pin 54 is provided is positioned to avoid the interference of the engaging portion 25.

When the cassette 2 is slid, the second engaging portion 256 may be interfered with the interference portion 521 of the locking lever 52. The pin 54 may move along the locking hole 511*a* and be positioned in the sliding hole 511*b*.

When the pin 54 is positioned in the sliding hole 511*b*, the pin 54 may be moved to the rear side (B) along the sliding hole 511*b* by the elastic force of the elastic member 53. The locking lever 52 to which the pin 54 is mounted may move in the rear side (B) together with the cassette 2. The protrusion 524 of the locking lever 52 may slide along the first hole 510 in the front and rear direction. The engaging portion 25 is positioned in the accommodation portion 523 located between the interference portion 521 and the pressing portion 522. Since the first engaging portion 253 is pressed by the pressing portion 522 of the locking lever 52, the first engaging portion 253 may be prevented from moving in the rear side as long as the external force is not applied. Accordingly, the cassette 2 may be inserted and mounted to the housing 10.

When the cassette 2 is inserted, the cassette 2 is lowered by a certain height just before being mounted to the housing 10, because the rear portion S2 of the rail portion 31 is inclined. Therefore, the cassette 2 may be automatically mounted to the housing 10 by the force generated when the cassette 2 is lowered, as well as by the elastic force of the elastic member 53. Since the cassette 2 is configured to be automatically mounted by the rail portion 31 having a height difference and by the elastic member 53, it may be possible to omit the configuration, e.g., a damper, and thus it may be possible to reduce the manufacturing cost of the image forming apparatus 1. Since the cassette 2 is mounted to the housing 10 by using the weight of the cassette 2, it may be possible to insert the cassette 2 into the housing 10 with a small force so as to improve the user experience.

The user may pull out the cassette 2 from the housing 10 at the front side (A). The first engaging portion 253 may press the pressing portion 522 of the locking lever 52, and the cassette 2 together with the locking lever 52 may be slid in the front side (A). The pin 54 may be moved along the sliding hole 511*b*, and when the pin 54 reaches the locking hole 511*a*, the pin 54 may be moved to the locking hole 511*a*. When the pin 54 is moved to the locking hole 511*a*, the pressure applied to the first engaging portion 253 by the pressing portion 522 of the locking lever 52 may be released. When the first engaging portion 253 in the pressed condition is released, the cassette 2 may be pulled out at the front side. In this time, the idle roller 23 may be slid along the rail portion 31.

FIG. 14A to 14D are views illustrating an operation when the cassette is erroneously mounted according to another example. In FIGS. 14A to 14D, it will be illustrated that the cassette 2 is inserted into the housing 10 in a state in which the pin 54 is positioned in the sliding hole 511*b* of the second hole 511. In the normal state, the cassette 2 is inserted into the housing 10 in a state in which the pin 54 is positioned in the locking hole 511*a* of the second hole 511. However, the pin 54 may be escaped from the locking hole 511*a* and then positioned in the sliding hole 511*b* due to various causes generated during the manufacturing, transportation or use. In this case, when the cassette 2 is inserted into the housing 10, it may be impossible to perform the operation as shown FIGS. 13A to 13C.

In a state in which the cassette 2 is provided with the engaging portion 24 of FIG. 10, when the cassette is inserted into the housing in as state in which the pin 54 is positioned in the sliding hole 511*b* before the above mentioned cassette is inserted into the housing 10, the second engaging portion 242 may be interfered with the interference portion 521 of the locking lever 52 and thus the cassette 2 is prevented from inserting into the rear side any longer. A portion of the front portion of the cassette 2 is protruded to the outside of the housing 10, and thus the cassette 2 is not fully mounted.

When the cassette 2 is provided with the engaging portion 25 of FIG. 12, the second engaging portion 256 may pass through the interference portion 521 of the locking lever 52 by the inclined surface 256*a* provided in the second engaging portion 256. The first connecting portion 254 may be interfered with the interference portion 521 after the second engaging portion 256 passes through the interference portion 521, and thus the cassette 2 is prevented from being inserted into the front side any longer.

In a state in which the second engaging portion 256 is passed through the interference portion 521, when a user pulls the cassette 2 out, the interference portion 521 may be interfered with the second connecting portion 255 and the locking lever 52 may be moved together with the cassette 2 in the front side. The pin 54 may be moved along the sliding hole 511*b* in the front side and then the pin 54 may be inserted into the locking hole 511*a* by passing through the sliding hole 511*b*. When the pin 54 is inserted into the locking hole 511*a*, it becomes the state in which the cassette 2 is mounted normally, and thus a user can properly mount the cassette 2 to the housing 10. Therefore, the cassette 2 may be mounted to the housing 10 properly, as illustrated in FIGS. 13A to 13C.

According to the conventional manner, when the pin 54 is positioned in the sliding hole 511*b* without being in the locking hole 511*a*, it may be required that a portion of the image forming apparatus 1 is disassembled or the pin 54 is positioned to the locking hole 511*a* after turning over the image forming apparatus 1 so that the cassette 2 is mounted properly.

However, according to the present disclosure, without disassembling the image forming apparatus 1 or directly adjusting the position of the pin 54 after turning over the image forming apparatus 1, the pin 54 may be positioned in the locking hole 511*a* by an operation in which the cassette 2 is inserted or pulled by the engaging portion 25 as illustrated in FIG. 12. Therefore, the cassette can be quickly mounted properly, and the user's convenience may be improved since an additional repair work is not required.

FIG. 15 is a view illustrating a configuration of a printing sheet outlet portion of the cassette according to an example, and FIG. 16 is a cross-sectional view illustrating the printing sheet outlet portion of the cassette according to an example.

Referring to FIGS. 15 and 16, according to an example, a printing sheet outlet portion 12 to which the printing sheet S loaded in the cassette 2 is discharged may be positioned in the front side of the accommodation portion 200. The printing sheet S may be guided to move to the upper side by the printing sheet outlet portion 12. The printing sheet outlet portion 12 may be further provided with an outlet portion guide 11. The outlet portion guide 11 may be mounted to one side of the inside of the housing 10. The outlet portion guide 11 may be pivotable with respect to a rotary shaft 110. The rotary shaft 110 may be formed in the injection-molded integrally with the outlet portion guide 11.

According to the conventional manner, the outlet portion guide may be fixed to the inside of the housing. When the outlet portion guide is fixed, the cassette 2 may be interfered with the outlet portion guide 11 when the rail portion guiding the movement of the cassette 2 is inclined.

According to the present disclosure, when a portion of the rear portion of the rail portion 31 is inclined so that the cassette 2 is lowered just before the cassette 2 is mounted, the cassette 2 may be easily inserted into or pulled out without being interfered with the outlet portion guide 11 since the outlet portion guide 11 is pivotable with respect to the rotary shaft 110 as illustrated in FIGS. 15 and 16. In addition, the outlet portion guide 11 and the printing sheet outlet portion 12 of the cassette 2 are configured not to be apart from each other as far as possible, and thus the printing sheet S discharged via the outlet portion guide 11 may be prevented from being bent or entering between the outlet portion guide 11 and the printing sheet outlet portion 12.

It may be possible to easily mount or detach the cassette 2, which is configured to be inserted into or pulled out from the image forming apparatus 1, by the automatic mounting apparatus 100 having the rail assembly 3 and the locking device 4 and 5. By omitting the configuration, e.g., a damper, it may be possible to reduce the manufacturing cost. When mounting the cassette 2 by the automatic mounting apparatus 100, it may be possible to prevent the impact or noise. Although the locking lever is in the position which causes a malfunction, it may possible to position the locking lever to the proper operation state without any inconvenient works, e.g., disassembling the components.

Although a few examples of the present disclosure have been shown and described, it would be appreciated by those skilled in the art that changes may be made in these examples without departing from the principles and spirit of the disclosure, the scope of which is defined in the claims and their equivalents.

The invention claimed is:

1. An image forming apparatus comprising:

a housing;

a cassette insertable into the housing, the cassette including an idle roller provided on a side surface of the cassette and an engaging portion protruding from a side surface of the cassette and positioned ahead of the idle roller toward a rear side of the cassette;

a rail portion provided in the housing; and a locking device, provided on a rear side of the rail portion, to interfere with the engaging portion, wherein a rear end portion of the rail portion is bent downward, and wherein the idle roller is to slide on the rear end portion of the rail portion to accelerate toward the locking device.

2. The image forming apparatus of claim 1, wherein the locking device comprises a case, a locking lever mounted on the case, and an elastic member connecting the locking lever to the case.

3. The image forming apparatus of claim 2, wherein the case is provided with a first hole extended horizontally and a second hole including a bent shape.

4. The image forming apparatus of claim 2, wherein the elastic member provides an elastic force so that the locking lever moves horizontally.

5. The image forming apparatus of claim 2, further comprising a plurality of elastic members.

6. The image forming apparatus of claim 5, wherein the plurality of elastic members is mounted on a link mounted on the case.

7. The image forming apparatus of claim 6, further comprising a protrusion formed in the case, wherein the link is formed to surround a portion of the protrusion so as to be pivotable with respect to the protrusion.

8. The image forming apparatus of claim 6, wherein the elastic member comprises a first elastic member connecting one side of the link to the locking lever and a second elastic member connecting the other side of the link to the case.

9. The image forming apparatus of claim 3, wherein the locking lever is movable along the first hole and the second hole.

10. The image forming apparatus of claim 9, further comprising a protrusion formed on a first side of the locking lever, wherein the protrusion is insertable into the first hole.

11. The image forming apparatus of claim 10, further comprising a pin mounted on a second side of the locking lever opposite to the first side, wherein the pin is movable along the second hole.

12. The image forming apparatus of claim 11, wherein one side of the elastic member is mounted on the pin and the other side of the elastic member is mounted on the case.

13. The image forming apparatus of claim 9, wherein the second hole comprises a sliding hole extended horizontally and a locking hole bent downward from the sliding hole.

14. The image forming apparatus of claim 2, wherein the locking lever comprises a pressing portion bent from one end portion thereof in a first direction and an interference portion bent from the other end thereof in the first direction.

15. The image forming apparatus of claim 1, wherein the engaging portion comprises a first engaging portion protruding on the side surface of the cassette, a second engaging portion being spaced apart from the first engaging portion in the front side, and a connecting portion connecting the first engaging portion to the second engaging portion.

16. An automatic mounting apparatus comprising:

an idle roller to couple to a side surface of a cassette;

an engaging portion to protrude from the side surface of the cassette and to be positioned ahead of the idle roller toward a rear side of the cassette;

a rail portion to couple to a side surface of a housing; and a locking device, provided on a rear side of the rail portion, to interfere with the engaging portion, wherein a rear end portion of the rail portion is bent downward, and wherein the idle roller is to slide on the rear end portion of the rail portion to accelerate toward the locking device.

17. The automatic mounting apparatus of claim 16, wherein the locking device comprises a case, a locking lever mounted on the case, and an elastic member connecting the locking lever to the case.

18. The automatic mounting apparatus of claim 17, wherein the case is provided with a first hole extended horizontally and a second hole including a bent shape.

19. The automatic mounting apparatus of claim 18, wherein the locking lever is movable along the first hole and the second hole.

20. The automatic mounting apparatus of claim 19, further comprising a protrusion formed on a first side of the locking lever, wherein the protrusion is insertable into the first hole.

* * * * *